United States Patent [19]

Nakamura

[11] Patent Number: 4,739,732

[45] Date of Patent: Apr. 26, 1988

[54] KIT FOR ATTACHING REED VALVES FOR 2-CYCLE ENGINES

[76] Inventor: Yukio Nakamura, 3-19, 1-Chome, Tengachayakita, Nishinari-Ku, Osaka-Shi, Osaka-Fu, Japan

[21] Appl. No.: 948,190

[22] Filed: Dec. 31, 1986

[51] Int. Cl.[4] ..... F02B 33/04

[52] U.S. Cl. ..... 123/73 V; 123/65 V

[58] Field of Search ..... 123/65 V, 73 A, 73 V

[56] References Cited

U.S. PATENT DOCUMENTS

| | | | |
|---|---|---|---|
| 2,639,699 | 5/1953 | Kiekhaefer | 123/73 V |
| 3,014,471 | 12/1961 | Eiler | 123/73 A |
| 3,042,013 | 7/1962 | Nelson | 123/73 V |
| 4,345,551 | 8/1982 | Bloemers | 123/73 A X |
| 4,474,163 | 10/1984 | Linder et al. | 123/73 V |

*Primary Examiner*—Willis R. Wolfe, Jr.

*Attorney, Agent, or Firm*—Armstrong, Nikaido, Marmelstein & Kubovcik

[57] ABSTRACT

A kit for post-installing reed valves between the cylinder block of a 2-cycle engine of a jet propelled small-sized boat and an inlet manifold is characterized in that the kit comprises base plate, a carburetor plate and a reed valve case interposed between two plates. The base plate is formed with two types of holes, i.e., plain holes through which attaching bolts are screwed into threaded holes in a cylinder block and threaded holes to be used in attaching the reed valve case. The carburetor plate and reed valve case are formed with plain holes, respectively, for alignment communication with the threaded holes in the base plate to receive other bolts. The arrangement is such that the reed valves removably fitted in the reed valve case are inseparably held between the reed valve case and the carburetor plate. Thus, the 2-cycle engine can be efficiently changed from the piston valve type to the reed valve type.

1 Claim, 10 Drawing Sheets

KIT FOR ATTACHING REED VALVES FOR 2-CYCLE ENGINES

BACKGROUND OF THE INVENTION

Jet-propelled small-sized boats of the type in which a single person is allowed to ride the boat in a standing posture on the floor deck at the stern while steering the boat for gliding freely over water surface have already been known. Such a small-sized boat has usually mounted thereon a 2-cycle engine having piston valve type cylinders.

In the case of such piston valve type cylinders, any degradation of fluid-tightness between the slide surfaces of the cylinders and piston rings caused as by deterioration of piston rings would immediately lead to a decrease in the engine output, adversely affecting the engine start characteristic and fuel cost.

SUMMARY OF THE INVENTION

In such cases, according to the present invention, there is no need to replace the entire engine by a new one and instead a reed valve attaching kit prepared in advance is installed, or post-installed, between the cylinder block and the inlet manifold, so that the piston valve type cylinders can be changed to the reed valve type, thereby solving the aforesaid problem.

In other words, a first object of the invention is to provide an arrangement wherein the reed valve attaching kit is composed of a base plate, a carburetor plate and a reed valve case interposed between said plates, reed valves being unseparably held as pre-units between said reed valve case and said carburetor plate, enabling replacement of the reed valves themselves and their attachment to the cylinder block to be effected very efficiently, the use of said reed valves thus attached preventing reverse flow of mixed gas and increasing the engine output and reducing fuel cost.

A second object of the invention is to provide an arrangement wherein the base plate is formed with plain holes adapted for alignment with threaded holes in the cylinder block, thus enabling the reed valves to be post-attached to the cylinder block very easily and with interchangeability, so that even when the positions of the threaded holes in the cylinder block changes with the engine type, such change can be accommodated by simply replacing the base plate alone.

Further, a third object of the invention is to provide an arrangement wherein even when the positions of the plain holes in the inlet manifold change, such change can be accommodated by simply replacing the carburetor plate alone. In addition, other objects of the invention will become apparent from the following description of an embodiment of the invention.

BRIEF DESCRIPTION OF THE DRAWINGS

The drawings show the present invention applied to a carburetor type parallel 2-cylinder 2-cycle engine.

DESCRIPTION OF THE PREFERRED EMBODIMENTS

Figure 1:
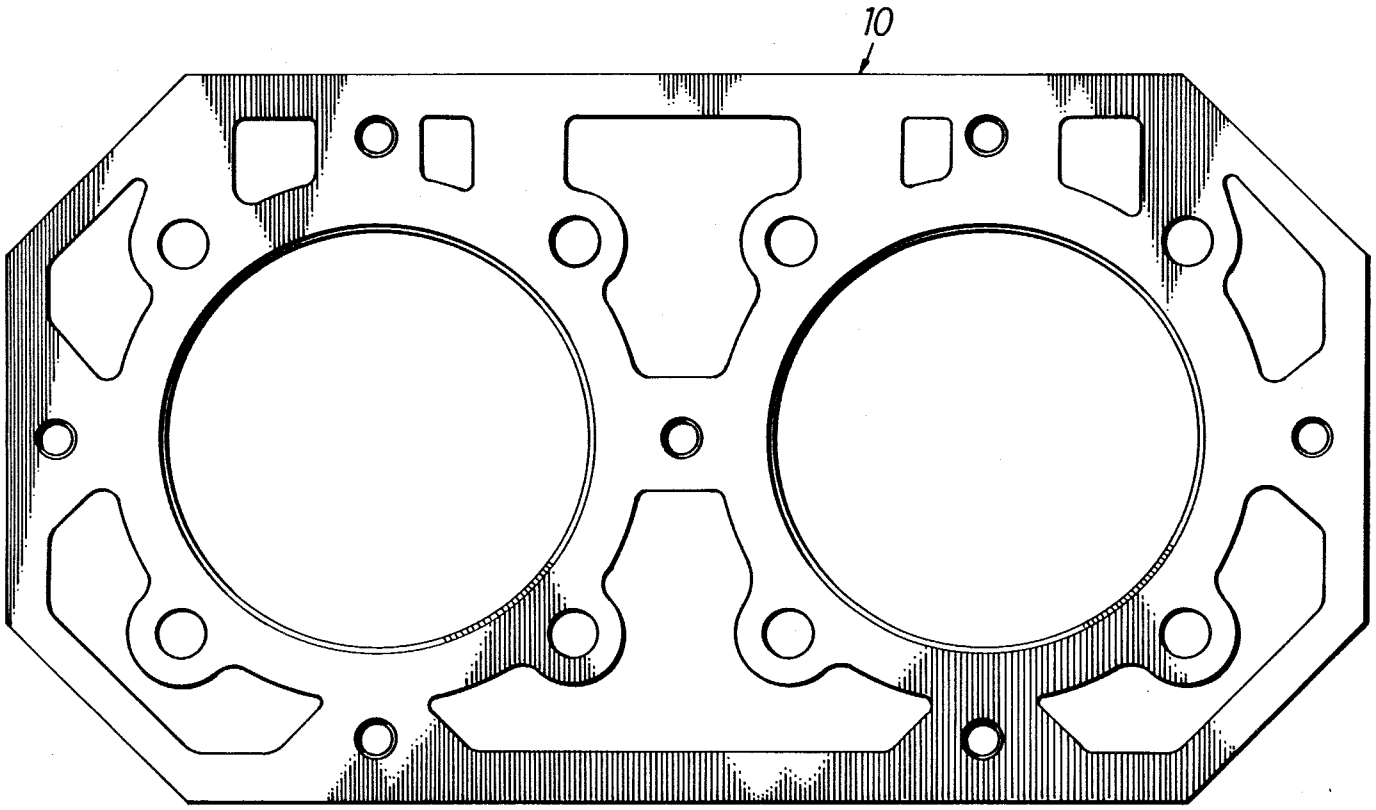
FIGS. 1 through 3 are a plan view, a front view and a rear view, respectively, of the cylinder block of said engine.
Figure 2:
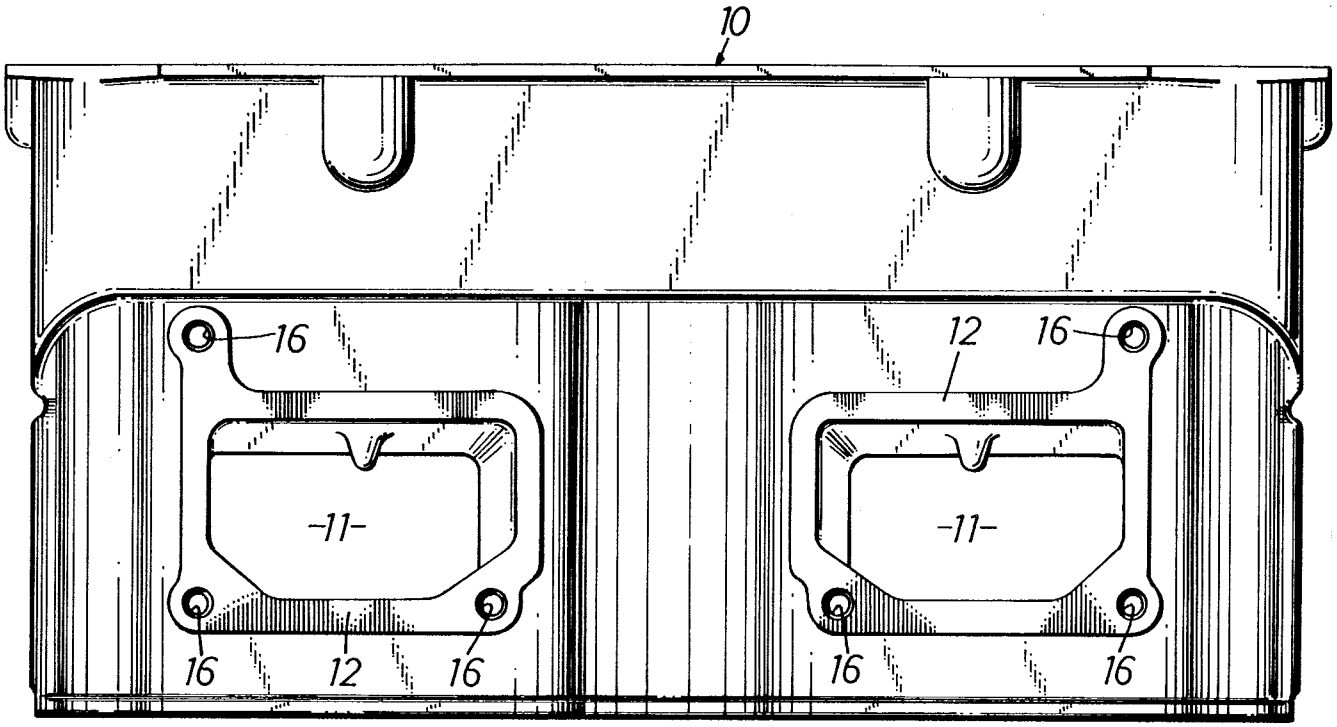
Figure 3:
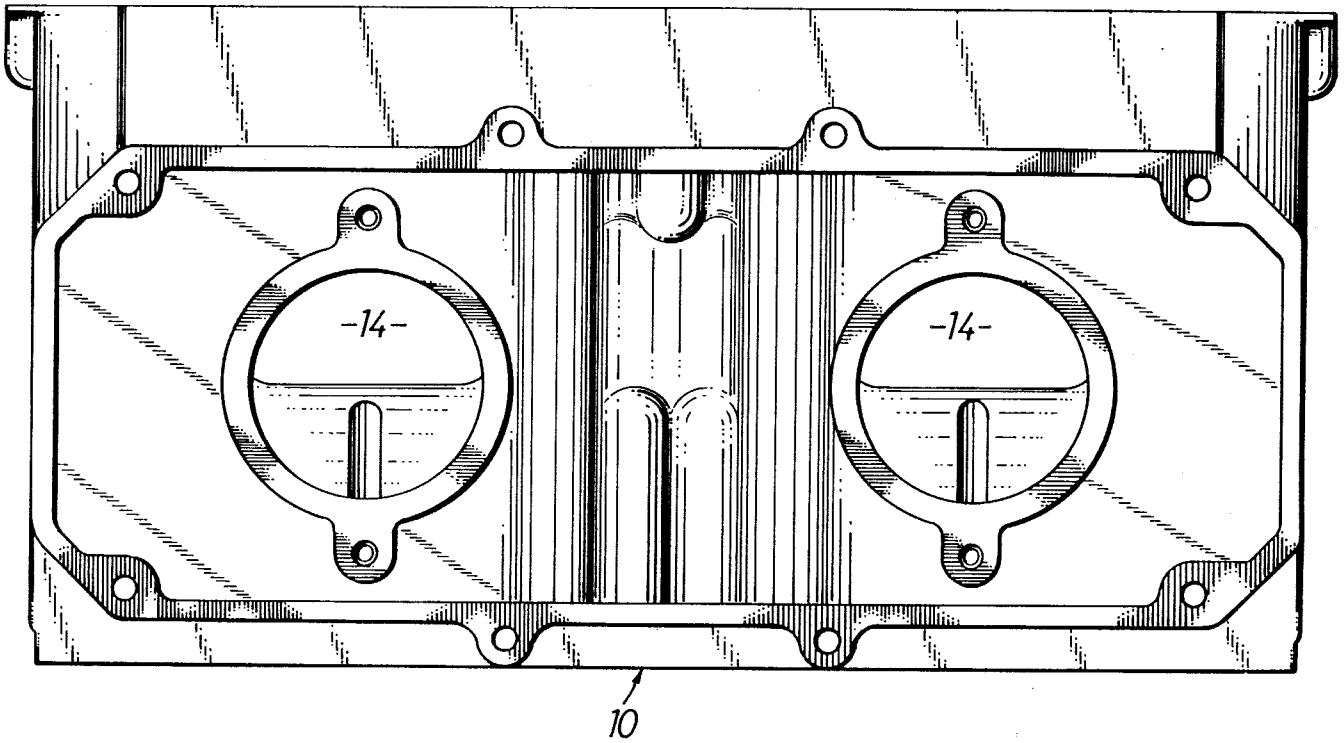
Figure 4:
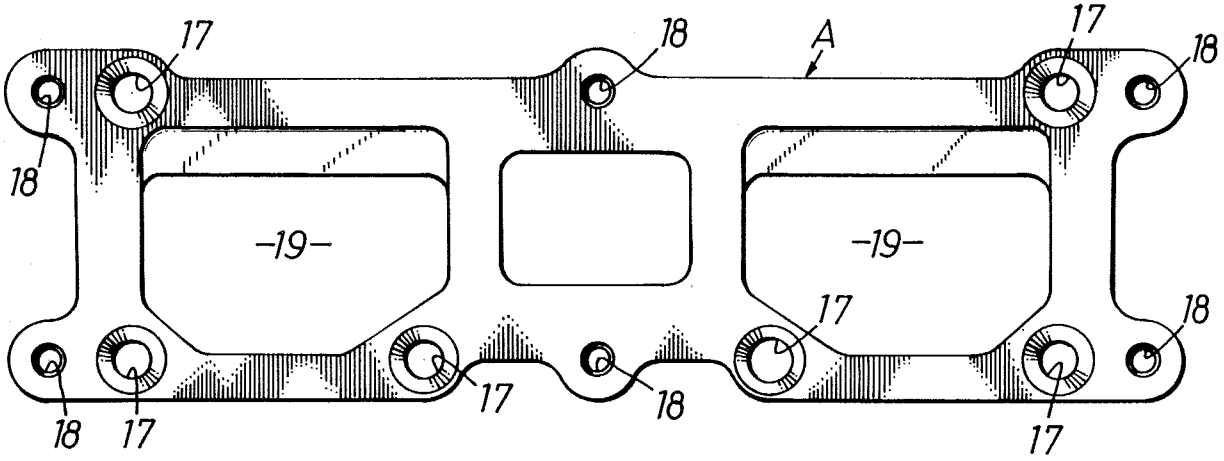
FIGS. 4 through 6 are front views of a base plate, a carburetor plate and a reed valve case, respectively.

The concrete arrangement of the invention will now be described with reference to the drawings. FIGS. 1 through 11 show the invention applied to a carburetor type parallel 2-cylinder 2-cycle engine. The kit of the invention comprises a base plate A, a carburetor plate B, and a reed valve case C, the reed valve case C having a reed valve units U removably fitted therein in a cassette fashion.

The base plate A is adapted to be mounted through a gaskets 13 on the seat surfaces 12 of a cylinder block 10 adjacent suction ports 11 and is cast from an aluminum alloy into a flat block form. The numeral 14 denotes an exhaust port in the cylinder block 10; 15 denotes scavenging ports in the cylinder block; and 16 denotes threaded holes formed in the seat surfaces 12. As is clear from FIG. 4, the base plate A is formed with a plurality of plain holes 17 adapted for alignment with threaded holes 16, and it is also formed with a plurality of threaded holes 18 to be used for attaching the reed valve case C. The numeral 19 denotes communication ports formed in the base plate A so that they are aligned with suction ports 11, the number of communication ports being increased or decreased according to the number of cylinders of the engine. In addition, plain holes 17 are counter-sunk, as shown.

Figure 5:
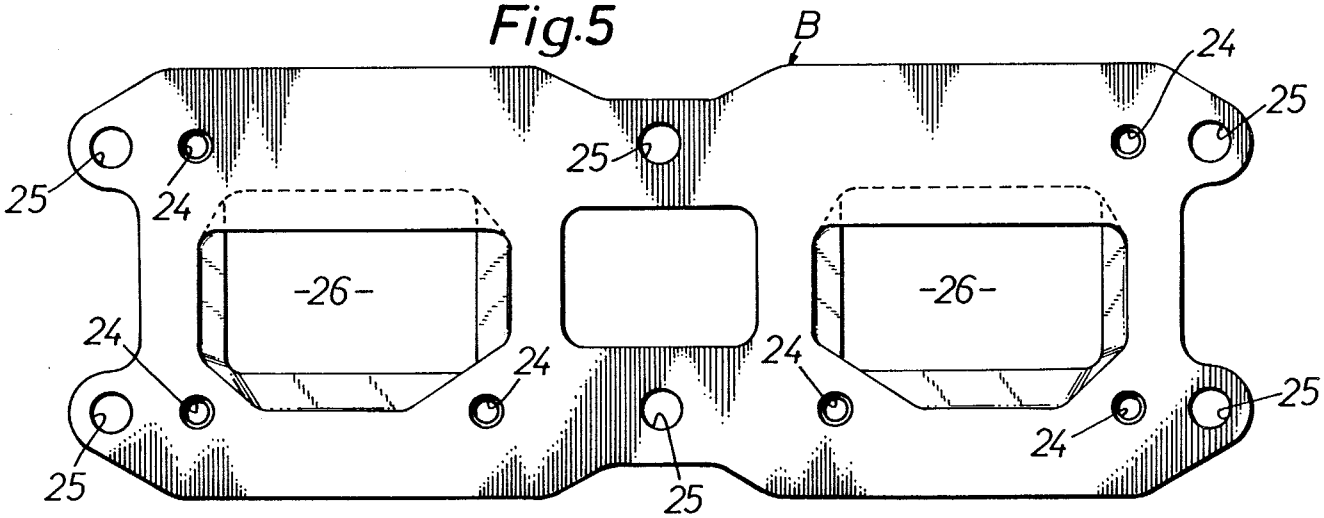

The carburetor plate B is also cast from an aluminum alloy into a flat block form and is adapted to be connected to an inlet manifold 20 through a gasket 21. The carburetor plate B, as shown in FIG. 5, is formed with a plurality of threaded holes 24 corresponding to plain holes 23 formed in connection seat surfaces 22, and a plurality of plain holes 25 to be used for attaching the reed valve case C, plain holes 25 being positioned for alignment with threaded holes 18 in the base plate A. The numeral 26 denotes communication ports formed in the carburetor plate B associated with the inlet manifold 20, the shape and size of the communication ports being substantially the same as those of communication ports 19. In the drawings, the inlet manifold 20 is shown as the straight type, but it may be the curved type and connected to the carburetor (not shown) in a down-port fashion.

Figure 6:
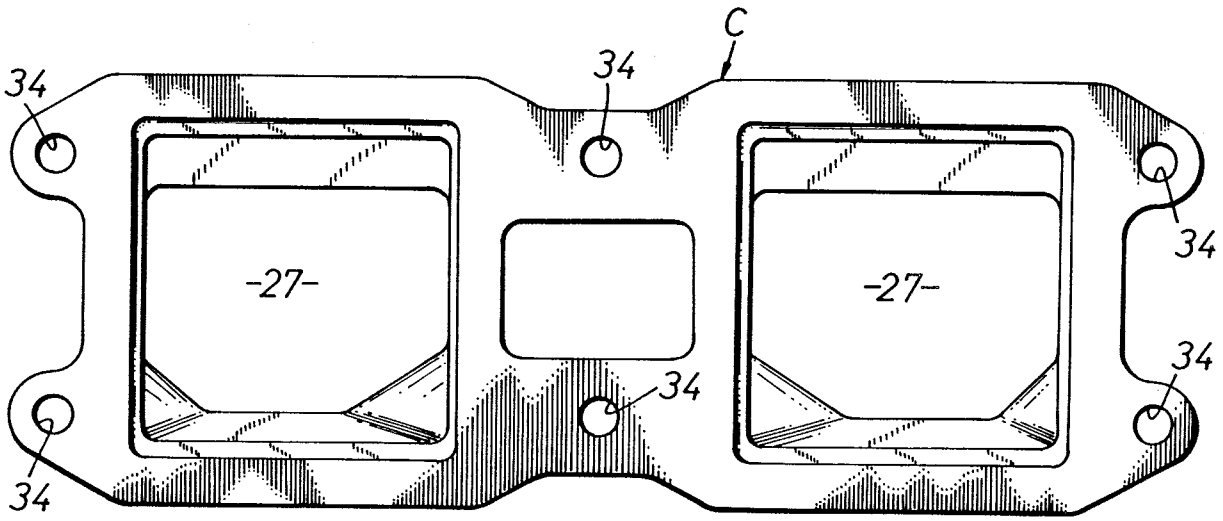
Figure 7:
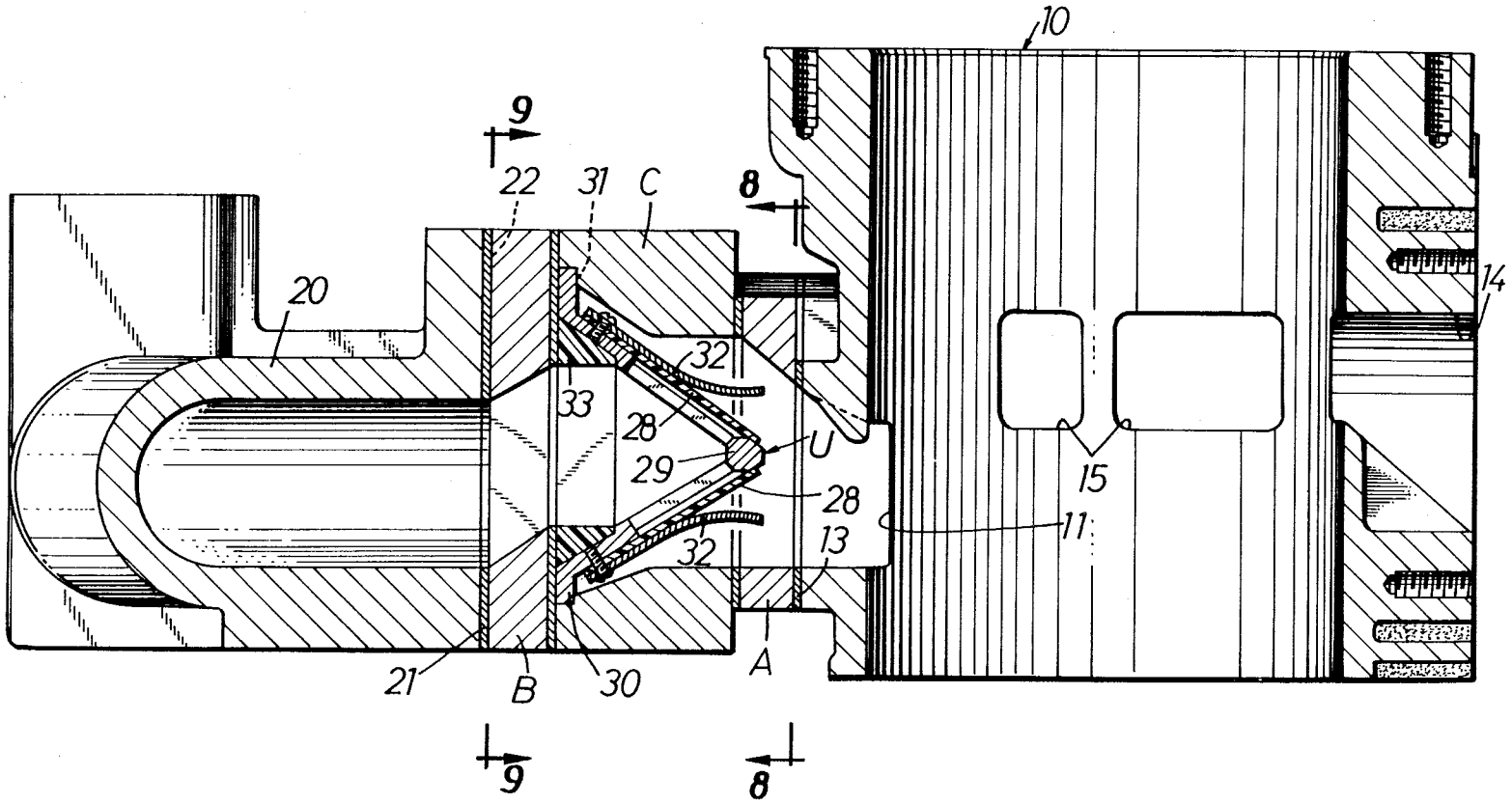
FIG. 7 is a side view, in longitudinal section, showing how the reed valve is attached.
Figure 8:
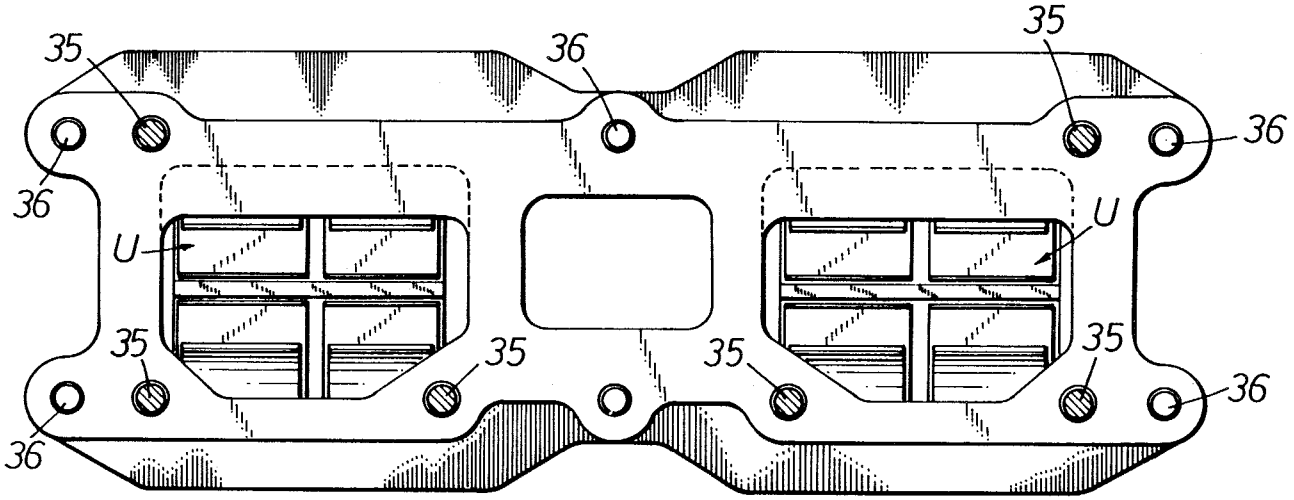
FIGS. 8 and 9 are sectional views taken along the lines 8—8 and 9—9, respectively, in FIG. 7.
Figure 9:
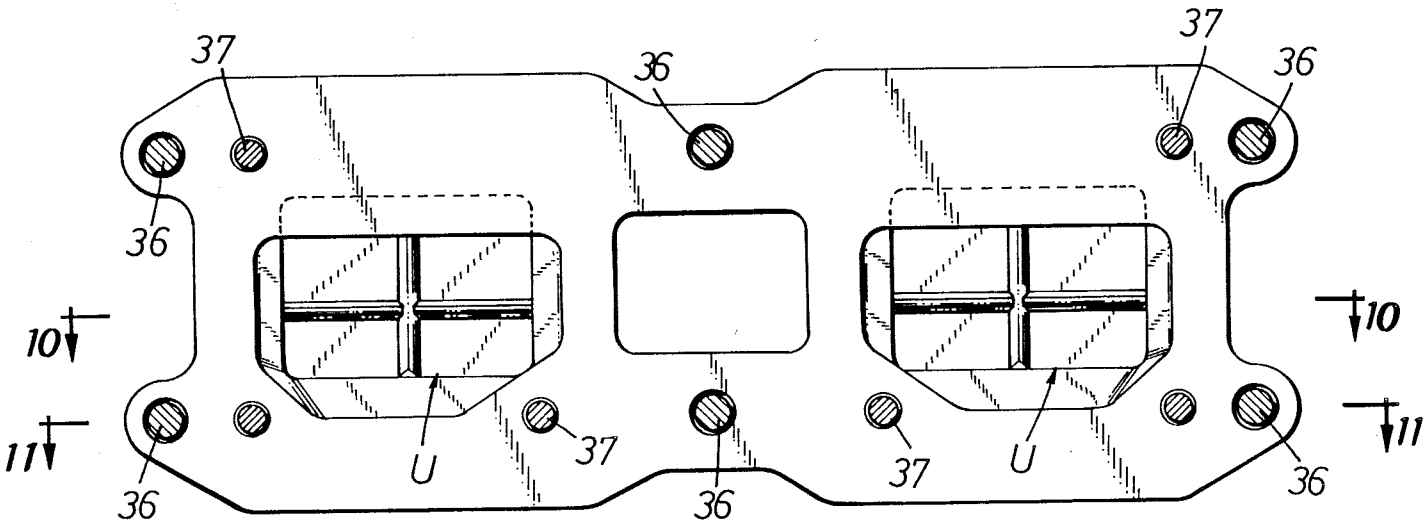
Figure 10:
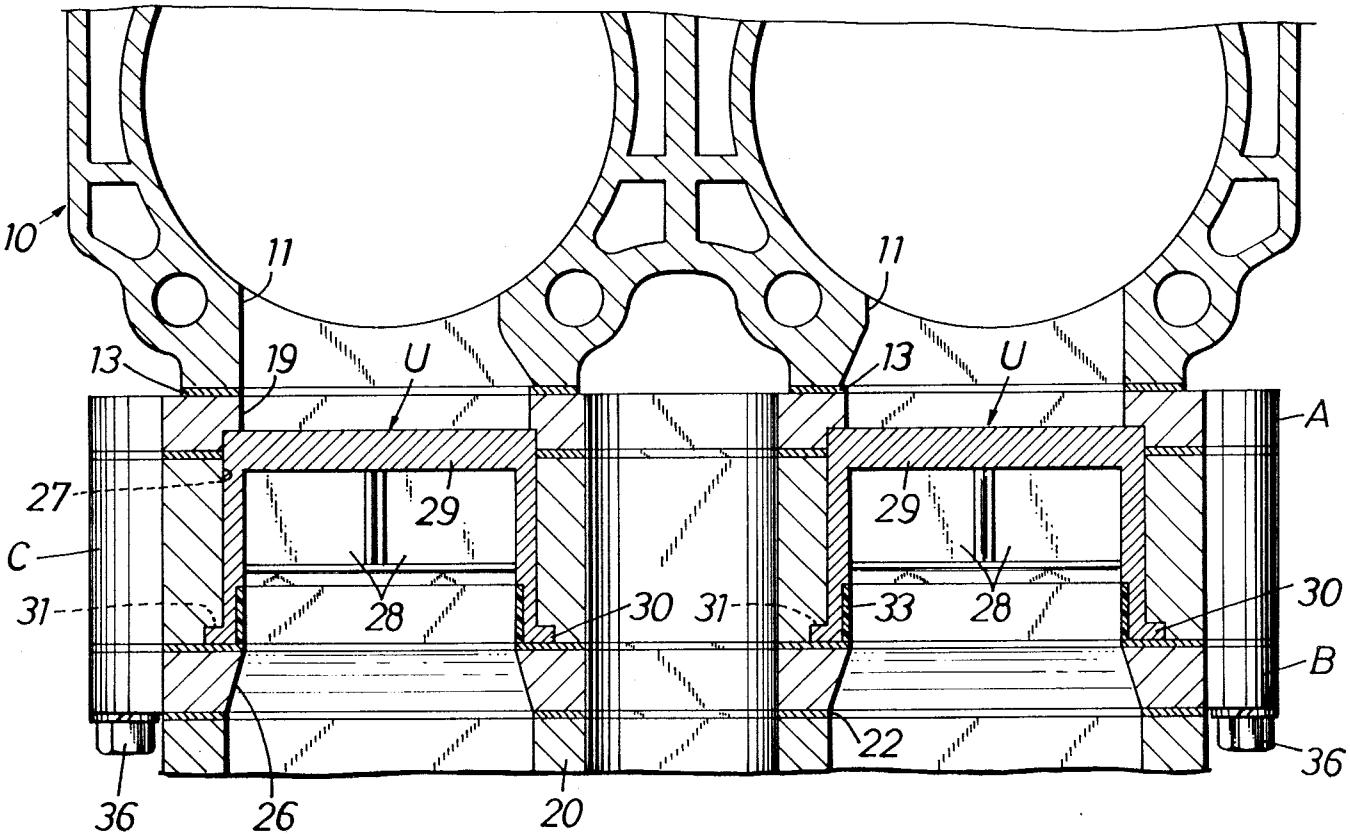
FIGS. 10 and 11 are fragmentary sectional views taken along the lines 10—10 and 11—11, respectively, in FIG. 9.
Figure 11:
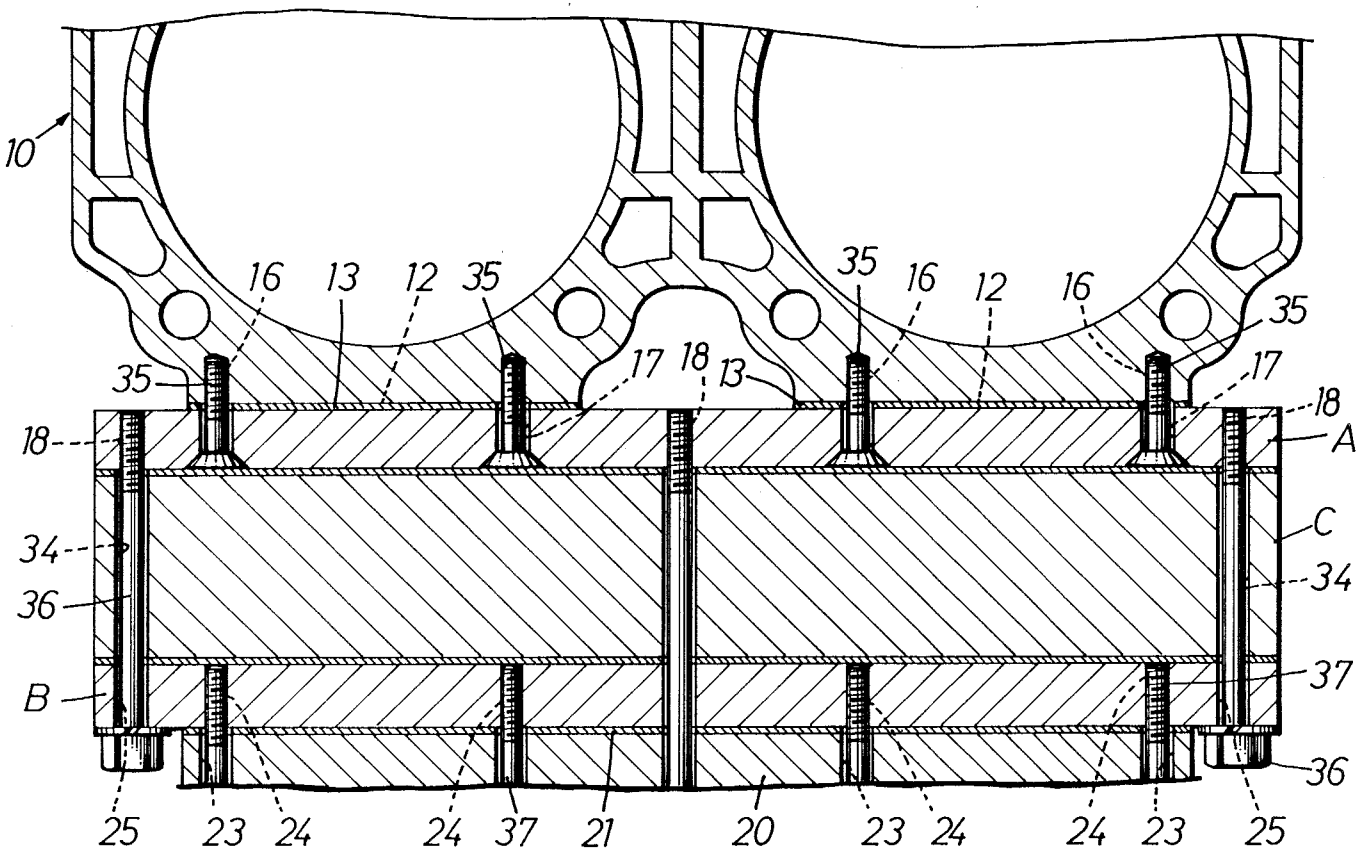

The reed valve case C is a casting of aluminum alloy in the form of a flat block thicker than the two plates A and B and is formed with reed valve clamping ports 27 larger than the communication ports 19 and 26 in the base plate A and carburetor plate B, as shown in FIG. 6. Removably clamped therein are reed valves 28 constituting unit bodies U.

Each reed valve 28 is attached to an angular unit frame 29 to open and close the suction passage, while the spreading opening edge 30 of the unit frame 29 is embedded in the concave step portion 31 of the fitting port 27 in the reed valve case C. The numeral 32 denotes opening control plates for the reed valves 28, fixed together with said reed valves 28 to the unit frames 29 by set screws. The numeral 33 denotes cover frames of synthetic resin. Thus, the unit bodies U containing the reed valves 28 can be replaced and new ones installed in the reed valve case C. The numeral 34 denotes a plurality of plain holes formed through the reed valve case C and positioned for alignment communication with the plain holes 25 in said carburetor plate B and threaded holes 18 in the base plate A.

Installation of the reed valves 28 in the cylinder block 10 using said kit can be effected by first aligning the plain holes 17 in the base plate A and screwing bolts 35 through said plain holes 17 into the threaded holes 16, thereby fixing the base plate A to the cylinder block 10. Subsequently, this operation is followed by aligning the plain holes 25 and 34 in the reed valve case C and carburetor plate B with the threaded holes 18 in the base plate A and screwing other bolts 36 through said plain holes 25 and 34 into the threaded holes 18, thereby fixing the reed valve case C and carburetor plate B to the base plate A.

As a result, as is clear from FIGS. 7 through 11, the reed valve units U fitted in advance in the clamping ports 27 in the reed valve case C are clamped between the reed valve case C and the carburetor plate B; thus, it is protected from separation, without having to be fixed as by separate set screws, and for replacement of the reed valves 28, the reed valves units U containing the same can be replaced. In addition, it goes without saying that the threaded holes 24 in the reed valve case C are aligned with the plain holes 23 in the inlet manifold 20 and bolts 37 are used for fixing.

As has so far been described, the reed valve attaching kit according to the invention comprises a base plate A, a carburetor plate B and a reed valve case C interposed between said two plates A and B, said base plate A being formed with two types of holes, i.e., plain holes 17 through which attaching bolts 35 are screwed into threaded holes 16 in a cylinder block 10 and threaded holes 18 to be used in attaching the reed valve case C, the carburetor plate B and reed valve case C being formed with plain holes 25 and 34, respectively, for alignment communication with the threaded holes 18 in the base plate A to receive other bolts 36. Therefore, once the plain holes 17 adapted to the threaded holes 16 in the cylinder block 10 are formed in the base plate A, the reed valves 28 can be easily post-attached to the cylinder block 10, and even if the positional relationship of the threaded holes 16 changes with the type of the cylinder block 10, such change can be accommodated by simply replacing the base plate A. There is no need of applying any special treatment to the cylinder block 10 for attachment.

The same can be said also of the case where the plain holes 23 in the inlet manifold 20 change. More particularly, even if the positional relationship of the plain holes 23 changes with the type of the inlet manifold 20, such change can be accommodated by replacing only the carburetor plate B.

Supposing that the size of the cylinder block 10 is constant, it follows that the greater the size of the reed valves 28 to be attached, the more the seat surfaces 12 are relatively limited in size, making it impossible or difficult to attach reed valves 28. In the present invention, however, since the base plate A is formed with plain holes 17 adapted to be aligned with the threaded holes 16 in the seat surfaces 12 and since it is also formed with threaded holes 18 to be used for attaching the reed valve case C, the reed valves 28 can be easily and stably attached without such impossibility or difficulty. Further, the reed valve case C is formed with large clamping ports 27 without any restriction and large reed valves 28 are attached thereto, thereby making it possible to increase the engine output.

Because of the arrangement wherein the reed valves 28 are installed in advance in the unit bodies U so that they can be held between the reed valve case C and the carburetor plate B, the replacement thereof can be very efficiently effected. Thus, the invention should be said to be useful.

What is claimed is:

1. A kit for attaching reed valves to the cylinder block of a 2-cycle engine of a jet-propelled small-sized boat between the engine carburetor and the engine block comprising a base plate, a carburetor plate and a reed valve case having reed valves therein and interposed between said base plate and said carburetor plate, said base plate having a plurality of unthreaded holes for alignment with threaded holes in said engine block for receiving attaching bolts for insertion therethrough and threading into said threaded holes in said cylinder block for attaching said base plate to said block and a plurality of threaded holes for attaching said reed valve case and said carburetor plate to said base plate and said block, said carburetor plate and said reed valve case having, respectively, unthreaded holes for alignment with said threaded holes in said base plate for receiving attaching bolts for insertion therethrough and threading into said threaded holes in said base plate for attaching said carburetor plate and said reed valve case to said plate and said block, said reed valve case having a recessed opening at the surface of said reed valve case abutting said carburetor plate and said reed valve case when said carburetor plate and said reed valve case are attached to said base plate for securing said reed valves to said reed valve case and said block.

* * * * *